US009392817B2

(12) United States Patent
Bachmann et al.

(10) Patent No.: US 9,392,817 B2
(45) Date of Patent: Jul. 19, 2016

(54) FILTER PAPER THAT DISINTEGRATES QUICKLY IN WATER

(71) Applicant: DELFORTGROUP AG, Traun (AT)

(72) Inventors: Stefan Bachmann, Fulpmes (AT); Dietmar Volgger, Schwaz (AT); Dieter Möhring, Wattens (AT); Kannika Pesendorfer, Salzburg (AT); Guido Reiter, Terfens (AT)

(73) Assignee: delfortgroup AG, Traun (AT)

( * ) Notice: Subject to any disclaimer, the term of this patent is extended or adjusted under 35 U.S.C. 154(b) by 0 days.

(21) Appl. No.: 14/416,680

(22) PCT Filed: May 14, 2013

(86) PCT No.: PCT/EP2013/001422
§ 371 (c)(1),
(2) Date: Jan. 23, 2015

(87) PCT Pub. No.: WO2014/015921
PCT Pub. Date: Jan. 30, 2014

(65) Prior Publication Data

US 2015/0173414 A1 Jun. 25, 2015

(30) Foreign Application Priority Data

Jul. 26, 2012 (DE) ..... 10 2012 106 801

(51) Int. Cl.

| | |
|---|---|
| ***A24D 1/02*** | (2006.01) |
| ***D21H 15/06*** | (2006.01) |
| ***A24D 3/06*** | (2006.01) |
| ***D21H 27/08*** | (2006.01) |
| ***A24D 3/10*** | (2006.01) |
| ***D21H 27/00*** | (2006.01) |
| ***D21H 11/20*** | (2006.01) |

(52) U.S. Cl.
CPC .. *A24D 1/02* (2013.01); *A24D 3/06* (2013.01); *A24D 3/068* (2013.01); *A24D 3/10* (2013.01); *D21H 11/20* (2013.01); *D21H 15/06* (2013.01); *D21H 27/00* (2013.01); *D21H 27/08* (2013.01)

(58) Field of Classification Search
USPC ..... 152/139, 141, 157.1, 157.6; 131/331, 131/360, 365; 429/39–50
See application file for complete search history.

(56) References Cited

U.S. PATENT DOCUMENTS

| | | | | |
|---|---|---|---|---|
| 2,038,679 | A | 4/1936 | Keine | |
| 5,678,577 | A * | 10/1997 | Matsumura | A24D 3/10 131/331 |
| 5,758,669 | A * | 6/1998 | Taniguchi | A24D 3/14 131/331 |
| 5,823,201 | A * | 10/1998 | Matsumura | A24D 3/10 131/331 |
| 6,568,402 | B1 | 5/2003 | Kaneki | |
| 2006/0174902 | A1 * | 8/2006 | Zhou | A24B 15/28 131/352 |

FOREIGN PATENT DOCUMENTS

EP 1098036 B1 1/2006

OTHER PUBLICATIONS

Baker, "Methylcellulose & Sodium Carboxymethylcellulose: Uses in Paper Conservation", The American Institute for Conservation, The Book and Paper Group Annual, v. 1, 1982, [online], retrieved from the Internet, [retrieved Sep. 2, 2015], <URL:http://cool.conservation-us.org/coolaic/sg/bpg/annual/v01/bp01-04.html>.*

"Introduction to Stock Prep Refining", Aikawa Fiber Technologies, no date, pp. 1-8, [online], retrieved from the Internet, [retrieved Sep. 2, 2015], <URL: http://www.aikawagroup.com/downloads/Training_Manual.pdf>.*

International Searching Authority—EPO, International Preliminary Report on Patentability, PCT/EP2013/001422; dated Feb. 5, 2015. 12 pages.

International Searching Authority—EPO International Search Report and Written Opinion, PCT/EP2013/001422; dated Jul. 31, 2013. 8 pages.

* cited by examiner

*Primary Examiner* — Dennis Cordray
(74) *Attorney, Agent, or Firm* — Sunstein Kann Murphy & Timbers LLP

(57) ABSTRACT

The invention relates to a paper that disintegrates quickly in water, for use as a filter material or filter wrapper paper of a cigarette filter. At least 80 wt % of the paper is formed by cellulose fibers. Of the cellulose fibers, at least 80 wt % are a mixture of long fiber pulp and mercerized pulp. 0 to 90 wt % of the content of the mixture is formed by mercerized pulp, and the rest is formed by long fiber pulp. The cellulose fibers of the mixture have a freeness of at most 30° SR according to ISO 5267. In the disintegration test using an apparatus as described in TAPPI T 261, the paper exhibits a disintegration of at least 60% after 30 seconds.

16 Claims, No Drawings

FILTER PAPER THAT DISINTEGRATES QUICKLY IN WATER

This application is a national phase entry of Patent Cooperation Treaty Application PCT/EP2013/001422, filed May 14, 2012, which claims priority from German Patent Application 10 2012 106 801.1, filed Jul. 26, 2012, which are incorporated herein by reference in their entireties.

TECHNICAL FIELD

The present invention relates to a paper for the production of a cigarette filter or for the use as filter wrapper paper. The invention further relates to a corresponding cigarette and a corresponding production process. The paper has the property of disintegrating quickly in water and thereby improves the biological degradability of a cigarette filter manufactured therefrom.

BACKGROUND ART

A conventionally produced filter cigarette generally consists of a cylindrical column of tobacco, which is wrapped with a cigarette paper, and a filter, which is made from a filter material and is wrapped with a filter wrapper paper. A common filter material is cellulose acetate. Typically, the tobacco column and the filter are connected to each other by a tipping paper.

The residue remaining after the consumption of a filter cigarette consists in large part of the filter. This residue is in many cases not disposed of in an orderly manner, but is but simply thrown away, for which reason it remains in the environment until it disintegrates due to environmental influences. During the decomposition process, firstly the tipping paper and the filter wrapper paper detach from the filter material. This process happens relatively quickly, while, depending on the environmental conditions, the cellulose acetate fibers take between one month and three years to be disintegrated. Consequently, there is an interest in the industry for finding materials for cigarette filters that are degraded in the environment substantially faster than cellulose acetate fibers.

As an alternative to cellulose acetate fibers, paper is also known for use as a filter material for cigarettes. While paper generally degrades in the environment faster than cellulose acetate, the degradation of known paper filters still occurs more slowly than desired.

The speed of decomposition of paper in water can be measured with an apparatus that is described in TAPPI Method T 261 "Fines fraction by weight of paper stock by wet screening". This apparatus consists of a cylindrical container with an internal diameter of 10 cm filled with warm distilled water at 23° C., the lower end of which is provided with a screen and closed by a discharge valve below the screen. In the container there is a stirring unit the speed of which can be set from 10 to 3000 revolutions per minute. The screen has 32 mesh per 25 mm and an opening width of 0.57 mm. Specifications regarding the stirring unit and its position in the container as well as further details of the apparatus can be taken from TAPPI T 261. The paper sample is put into the container while the stirring unit is running and the water with the paper sample is stirred for a defined period at a defined revolution speed. Then the water is discharged by opening the discharge valve, so that the fibers remain on the screen. The screen with the fibers is then dried and the fraction of disintegrated paper is determined by image analysis.

In detail, the measurement proceeds as follows. The paper to be measured is conditioned for at least two hours under the conditions defined in ISO 187. A small 20±0.5×20±0.5 mm sheet is cut out. At the start of the measurement, the container is filled with 800 ml of water. Then the stirring unit is turned on and set to a revolution speed of 800 revolutions per minute. The paper sample is put into the container, where it can disintegrate by the action of the shear forces caused by the stirring unit. The stirring unit is stopped 30 seconds after adding the sample and the water is immediately discharged by opening the discharge valve. Individual fibers and paper pieces, which did not disintegrate, remain on the screen.

After discharging the water the screen together with the fibers is dried in a drying oven for 5 minutes at 105° C. The amount of fibers left on the screen is determined by image analysis. To this end, the screen with the residues of the paper sample is placed on a black substrate and an image in grayscale with sufficient resolution is taken with a digital camera. This image is analyzed with appropriate software, for example the program "Image J".

In the acquired digital image, the screen and individual fibers will appear dark, while non-disintegrated fiber bundles and larger residues of the paper appear light. A grayscale value is defined as the threshold that clearly distinguishes the screen and individual fibers from fiber bundles and paper residues. For a steadily increasing grayscale of 256 values characterized by values from 0 (black) to 255 (white), a value of 140 is adequate in many cases, whereupon, for a reasonable choice of threshold value, the result depends only to a small extent on the precise numerical value.

Afterwards, the number of pixels that have a grayscale value greater than the threshold value and hence belong to fiber bundles or larger residues of paper is counted. The ratio of the number of these pixels to the total number of pixels that corresponds to an undamaged paper sample of 20×20 mm is determined. This ratio is subtracted from 1 and expressed as a percentage. The higher the percentage, the more the paper has disintegrated.

In rare cases it can happen that the slightly disintegrated paper samples are deposited on the screen folded rather than flat. Because of the smaller visible paper surface, these samples would wrongly indicate greater disintegration of the paper. In such a case, the sample has to be discarded and the measurement has to be repeated with a new sample.

A result of at least 60% in this disintegration test corresponds to a paper that completely disintegrates in a container with water under slight movement within a few minutes, while conventional papers, for which the disintegration test delivers lower results, do not show any signs of disintegration under these conditions even after hours.

Cigarette filters manufactured from such conventional papers suffer from the disadvantage of degrading in the environment more slowly than desired. In general, it has to be said that conventional papers, which have a sufficient stability in the dry state, for example so that they can be processed by a machine, as a rule dissolve in water more slowly than desired for the purposes of the present invention.

Attempts have been made in the prior art to develop paper materials that dissolve in water comparatively quickly. An example in this regard is the use of unbleached pulp, from which indeed quickly disintegrating filters can be produced, but which, however, provides a filter with a light brown color, which is generally undesirable.

SUMMARY

The object of the present invention is to provide a filter material that can be produced easily and inexpensively and which at the same time disintegrates comparatively quickly in water. This objective is achieved by means of a paper that disintegrates quickly in water according to claim 1 and its production process according to claim 13. A further object of the invention is a filter cigarette that uses this material. Advantageous further embodiments are disclosed in the dependent claims.

According to the invention, a paper that disintegrates quickly in water is proposed for use as filter material, which has the following properties:

- at least 80% by weight, preferably at least 90% by weight and particularly preferably at least 95% by weight of the paper is formed from pulp fibers,
- of said pulp fibers, at least 80% by weight, preferably at least 90% by weight and particularly preferably at least 95% by weight consist of a mixture of long fiber pulp and mercerized pulp,
- wherein 0 to 90% by weight of said mixture consists of mercerized pulp and the rest of long fiber pulp, and
- wherein the pulp fibers of said mixture have a freeness determined according to ISO 5267 of at least 30° SR, preferably at least 25° SR and particularly preferably at least 20° SR,
- in a disintegration test using an apparatus described in TAPPI T 261, the paper exhibits a disintegration of at least 60%, preferably of at least 70% and particularly preferably of at least 80% after 30 seconds.

The inventors have found that by combining a special pulp, a comparatively high pulp fraction and a comparatively low freeness of the pulp fibers, a paper can be manufactured that disintegrates quickly in water despite sufficient stability in the dry state, and which is appropriate for use as a filter material for a cigarette filter. Such a paper, however, can also advantageously be used as a filter wrapper paper, which should itself disintegrate quickly in water for the same reasons as the filter material.

Due to a refining of comparatively low intensity, excessive fibrillation of the fiber bundles is avoided and thus, the possibility of the formation of hydrogen bonds in the fiber network is limited, which counteracts the dissolution of the paper in water.

At the same time, however, the same hydrogen bonds in conventional papers are responsible for providing the paper with sufficient mechanical strength in the dry state. An appropriate compromise between these apparently contradictory properties of disintegration in water and mechanical strength in the dry state is achieved in the context of the invention by the use of a mixture of long fiber pulp and mercerized pulp, wherein the mixture consists of at most 90% by weight of mercerized pulp with the remainder being long fiber pulp. In other words, this "mixture" includes the possibility of the entire pulp being long fiber pulp. Examples of mercerized pulp are pulps that are treated with sodium hydroxide solution in order to provide the paper with a particularly large volume at low density.

Furthermore, a sufficient strength in the dry state is favoured by keeping the pulp content comparatively high, and hence only a little or even no fillers are used. As will be shown below by three exemplary embodiments, a filter or filter wrapper paper can be obtained that combines sufficient strength in the dry state with fast disintegration in water by the choice of pulps, the high fraction of pulp in the entire mass and the low freeness in accordance with the invention.

The mean fiber length of the long fiber pulp is more than 1 mm, preferably more than 2 mm and less than 5 mm, preferably less than 4 mm. The long fiber pulp can be derived from coniferous wood, particularly from spruce or pine.

In the prior art it is known to apply starch, starch derivatives or cellulose derivatives to the surface of the paper in the size or film press of a paper machine to increase the strength of the paper and to improve certain other properties of the paper. Application in the size or film press is particularly necessary if the substances are water-soluble and would be lost to a large part on the screen, in the press section and in the drying section if they are dissolved in water in an early stage of the paper production, for example in the pulper or the head box.

The inventors have, however, found that the desired properties, that is good mechanical strength in the dry state and quick disintegration in water, can be produced particularly well if the pulp fiber suspension is in the wet state, in any case before optional processing in a size or film press of a paper machine, treated with a water-soluble cellulose derivative, particularly with carboxy methyl cellulose (CMC). This is a surprising result because it was found that in fact, the largest part of the water-soluble starch derivative does not get into the paper, but typically remains in a dissolved state in the screen water. If the fraction of the cellulose derivative is, for example 20% by weight of the fiber mass in the pulper, a fraction of the cellulose derivative in the finished paper is found, which is significantly below 3% by weight of the finished paper, typically substantially below 1% by weight of the finished paper. In spite of this comparatively low fraction of the cellulose derivative remaining in the paper, it was found, however, that the mechanical strength in the dry state as well as the degradability in water are increased thereby, which is an optimal effect in view of the present invention.

Furthermore, it was found that the manner of treatment with the cellulose derivative is of decisive importance and in certain respect has a greater importance than the absolute content of cellulose derivative in the finished paper. This is because the inventors have found that the preferred effect does not occur for a conventional treatment in the size or film press of a paper machine, although in this case a very much higher content of the cellulose derivative in the finished paper can be achieved than in the case of an addition to the pulper, the head box or the screen section, where, as was mentioned, a large part of the cellulose derivative is lost with the screen water. The inventors suppose that this special technical effect is caused by the fact that the cellulose derivative coats the fibers superficially and obstructs the formation of hydrogen bonds, but at the same time leads to adhesion of the fibers, which in spite of that ensures a comparatively high mechanical strength or breaking strength of the paper, respectively, in the dry state. In water, however, the cellulose derivative is dissolved quickly, whereupon the paper then disintegrates quickly.

The resulting paper has a measurable, but comparatively low fraction of water-soluble cellulose derivative, which is between 0.1% by weight and 3% by weight, preferably between 0.3% by weight and 2% by weight. The comparatively low fraction of the cellulose derivative is a consequence of the treatment of the pulp fiber suspension before an optional processing in a size or film press of the paper machine.

In an advantageous embodiment, the invention therefore concerns a cigarette filter paper or filter wrapper paper according to a previously described embodiment of the invention, which can be obtained by the treatment of a pulp fiber suspension used in paper production with a water-soluble cellulose derivative before optional processing in a size or film press of a paper machine. In this regard, the wording "before optional processing in a size or film press in a paper machine" indicates that for production, a size or film press does not necessarily have to be used, but it excludes treatment, as is conventional in the prior art, in such a size or film press that, according to the inventors' investigations precisely does not provide the particularly advantageous properties of the paper for the purposes of the invention.

In this regard, the treatment of the pulp fiber suspension can comprise one or more of the following process steps:

- addition of the cellulose derivative to the fiber mass in a pulper, wherein the fraction of the cellulose derivative is preferably more than 5% by weight, particularly preferably more than 10% by weight of the fiber mass in the pulper,
- addition of the cellulose derivative into the pulper of the paper machine, and/or
- application onto a still moist pulp fiber suspension web running in the paper machine before the size or film press.

Application can in particular be carried out by spraying, for example in the screen section of the paper machine.

In a particularly advantageous embodiment, the cellulose derivative is formed by carboxy methyl cellulose (CMC), whereby particularly a sodium-CMC with a degree of substitution of 0.6 to 0.95, preferably of 0.65 to 0.9, has been proved advantageous.

In an advantageous embodiment, the filter or filter wrapper paper has a breaking strength according to ISO 1924 of at least 9 N/15 mm, preferably at least 10 N/15 mm and particularly preferably at least 12 N/15 mm. Such values for the breaking strength are sufficient to allow further automatic processing of the paper, whereby breaking strengths of more than 12 N/15 mm are preferred.

Preferably, the filter paper or filter wrapper paper has a basis weight of 10 to 50 g/m$^2$, particularly preferably of 20 to 40 g/m$^2$.

Production of the filter paper is preferably carried out on an inclined wire machine, because on these machines, paper with a particularly high porosity can be produced, the filtration efficiency of which is particularly well suited to the filtration of cigarette smoke. Less preferred alternatives are Fourdrinier machines or vat machines.

In order to produce a filter plug from the filter paper, a paper web with a width, for example, of approximately 30 cm is typically embossed and/or creped, at times also under elevated temperature or humidity. The filter paper is then, as with conventional cellulose acetate filters, formed into an endless rod, which is wrapped with a filter wrapper paper. Filter plugs are subsequently cut from this rod.

Apart from the conventional process aids used in paper production, no further components for the production of the paper according to the invention are required; in this respect, the paper according to the invention can indeed be manufactured easily and inexpensively. Additionally, however, special substances can be added to the paper to increase or improve its filtration effect. In a preferred embodiment, the paper contains metal oxides, which catalytically facilitate the degradation of CO to CO2, for example iron oxides. Equally, other substances that selectively remove certain components of the cigarette smoke from the smoke can be used, such as carbonates, for example, sodium or potassium carbonate, or bicarbonates, for example, sodium, potassium or ammonium bicarbonate or phosphates, for example, sodium or potassium phosphate. These substances, however, should either dissolve rapidly in water, or, if they are water-insoluble, should be present in particles small enough not to have a negative influence on the disintegration of the paper according to the invention in water.

DETAILED DESCRIPTION

The invention will now be illustrated with the aid of the following three exemplary embodiments:

Exemplary Embodiment 1

A filter paper according to the invention was produced from 100% by weight long fiber pulp with brand name Södra Green 85 FZ on an inclined screen machine. This pulp is produced from pine and spruce wood and has a mean fiber length between 2.35 mm and 2.65 mm. The pulp was refined to a freeness of 15° SR to achieve sufficient breaking strength. The paper had a basis weight of 26.9 g/m$^2$ and a breaking strength of 10.6 N/15 mm. In the disintegration test, a disintegration of the paper of 80% to 85% was found.

Exemplary Embodiment 2

A filter paper according to the invention was produced on an inclined wire machine from 70% by weight of long fiber pulp with brand name Södra Green 85 FZ, with respect to the entire fiber mass of the paper, and from 30% by weight mercerized pulp, also with respect to the entire fiber mass of the paper, with brand name Buckeye HPZ. The fibers were refined to a freeness of 15° SR. The paper had a basis weight of 28.6 g/m$^2$ and a breaking strength of 9.7 N/15 mm. In the disintegration test, a disintegration of 80% to 85% was found.

Exemplary Embodiment 3

A filter paper according to the invention was produced on an inclined wire machine from 100% by weight of long fiber pulp with brand name Södra Green 85 FZ. During dispersion of the pulp in the pulper, CMC with brand name Blanose® 7ULC was added in an amount of 20% by weight of the fiber mass. The pulp fibers treated with CMC were refined to a freeness of 15° SR. The paper had a basis weight of 27.9 g/m$^2$ and a breaking strength of 14.81 N/15 mm. The fraction of CMC in the paper was less than 1% by weight with respect to the entire paper mass. In the disintegration test a disintegration of 96% to 99% was found.

The preceding three exemplary embodiments show that with the filter paper according to the invention, in fact a sufficient mechanical strength in the dry state, that is, a breaking strength of about 10 N/15 mm or more, can be combined with the ability to disintegrate quickly in water. This is even more remarkable because the paper with the advantageous properties can be produced exceptionally easily and therefore inexpensively.

Exemplary embodiment 3 furthermore exhibits the special technical effect that can be achieved by the addition of water-soluble cellulose derivatives, in this specific case CMC with brand name Blanose® 7ULC. Blanose® Refined CMC is a sodium CMC with minimal purity of 98% and anionic charge. The degree of substitution of Blanose® 7ULC, measured according to MA 304.1506A, is 0.65-0.90 with 7.0% to 8.9% sodium content. By adding CMC, as can be seen in comparison with exemplary embodiment 1, the breaking strength can be substantially increased and also the disintegration of the paper can be accelerated. This is a surprising and remarkable result, as typically the rate of disintegration in water and the breaking strength are competing parameters in the sense that an optimization of one is typically at the expense of the other.

These three exemplary embodiments are compared below with two comparative examples, which are not embodiments of the invention.

Comparative Example 1

A paper not according to the invention was produced from 100% by weight long fiber pulp with brand name Södra Green 85 FZ on a Rapid Köthen sheet former unit with a static sheet former from the company PTI Paper Testing Instruments GmbH, type RK3-KWT, serial number 0311. The pulp fibers were refined to a freeness of 50° SR. The paper had a basis weight of 26.6 g/m$^2$ and a breaking strength of 19.54 N/15 mm. The disintegration test showed a disintegration of the paper of 0%. The comparative example 1 differs from the exemplary embodiment 1 essentially in that the freeness is selected to be much higher, at 50° SR. It can be seen that the paper has a substantially higher breaking strength, but disintegrates in water only very slowly.

Comparative Example 2

A paper not according to the invention was produced on an inclined wire machine from 100% by weight long fiber pulp with brand name Södra Green 85 FZ. The pulp was refined to a freeness of 15° SR. The paper was completely impregnated with a 2% aqueous solution of CMC with brand name Blanose® 7ULC in the size press. The paper had a basis weight of 26.8 g/m$^2$ and a breaking strength of 13.88 N/15 mm. The fraction of CMC in the paper was 1 to 2% by weight. The disintegration test showed a disintegration of the paper of 40 to 50%.

In comparative example 2, [L1] CMC was applied in the size press according to the conventional method in paper production, so that approximately the same amount of CMC was present in the paper as in exemplary embodiment 3. The result of the disintegration test, however, shows that a later application of CMC onto the approximately dry paper, as occurs in the paper machine, does not lead to the desired effect, but instead addition in the pulper, as in exemplary embodiment 3, or at least application onto the still moist paper, is necessary for rapid disintegration of the paper.

Comparing comparative example 2 with exemplary embodiment 1 further shows that application of CMC in the size press leads to an increase in the breaking strength, but at the same time slows down the disintegration in water and is therefore not suitable for the purposes of the invention.

What is claimed is:

1. A paper that disintegrates quickly in water for use as a cellulose acetate free filter material or filter wrapper paper of a cigarette filter, with the following properties:

at least 90% by weight of the paper is formed by pulp fibers, of said pulp fibers, at least 80% by weight consists of a mixture of long fiber pulp and mercerized pulp, wherein the mean fiber length of the long fiber pulp is more than 2 mm, and wherein the long fiber pulp is derived from coniferous wood, wherein 0 to 90% by weight of said mixture consists of mercerized pulp and the rest of long fiber pulp, wherein the pulp fibers of said mixture have a freeness determined according to ISO 5267 of at most 20° SR, wherein in a disintegration test using an apparatus described in TAPPI T 261, the paper exhibits a disintegration of at least 60% after 30 seconds, wherein the paper has a breaking strength according to ISO 1924 of at least 9 N/15 mm, and wherein the paper has a basis weight of 10 to 50 g/m$^2$.

2. The paper according to claim 1, which contains a water-soluble cellulose derivative.

3. The paper according to claim 2, in which the fraction of the water-soluble cellulose derivative is between 0.1% by weight and 3% by weight.

4. The paper according to claim 2, obtainable by treatment of a pulp fiber suspension used in paper production with one or more water-soluble cellulose derivatives before optional processing in the size or film press of a paper machine.

5. The paper according to claim 4, in which the treatment of the pulp fiber suspension comprises one or more of the following process steps:

addition of the cellulose derivative to the fiber mass in a pulper, addition of the cellulose derivative to the head box of a paper machine, and application onto a still moist web of pulp suspension running in the paper machine by spraying in the screen section of the paper machine.

6. The paper according to claim 4, wherein in the step of adding the cellulose derivative to the fiber mass in said pulper, the fraction of the cellulose derivative is more than 5% by weight of the fiber mass in the pulper.

7. The paper according to claim 2, in which the cellulose derivative is formed by a sodium carboxy methyl cellulose (CMC) with a degree of substitution of 0.65 to 0.9.

8. The paper according to claim 2, in which the fraction of water-soluble cellulose derivative is between 0.3% by weight and 2% by weight.

9. The paper according to claim 1, which further contains metal oxides that catalytically facilitate the degradation of CO to CO2.

10. The paper according to claim 1, in which the paper has a breaking strength according to ISO 1924 of at least 10 N/15 mm.

11. Filter cigarette, the filter and/or filter wrapper paper of which is a cellulose acetate free paper having the following properties:

at least 90% by weight of the paper is formed by pulp fibers, of said pulp fibers, at least 80% by weight consists of a mixture of long fiber pulp and mercerized pulp, wherein the mean fiber length of the long fiber pulp is more than 2 mm, and wherein the long fiber pulp is derived from coniferous wood, wherein 0 to 90% by weight of said mixture consists of mercerized pulp and the rest of long fiber pulp, wherein the pulp fibers of said mixture have a freeness determined according to ISO 5267 of at most 20° SR, wherein in a disintegration test using an apparatus described in TAPPI T 261, the paper exhibits a disintegration of at least 60% after 30 seconds, wherein the paper has a breaking strength according to ISO 1924 of at least 9 N/15 mm, and wherein the paper has a basis weight of 10 to 50 g/m$^2$.

12. A process for producing a cellulose acetate free filter paper or filter wrapper paper with a base weight of 10 to 50 g/m2 and a breaking strength according to ISO 1924 of at least 9N/15 mm, said process comprising the following steps:

refining a mixture of long fiber pulp and mercerized pulp to a freeness of at most 20° SR, wherein 0 to 90% by weight of the mixture consists of mercerized pulp and the remainder of long fiber pulp, wherein the mean fiber length of the long fiber pulp is more than 2 mm, and wherein the long fiber pulp is derived from coniferous wood, using the pulp mixture in the production of the paper, wherein the mixture accounts for at least 70% by weight of the entire pulp employed, and the entire pulp accounts for at least 90% by weight of the paper.

13. The process according to claim 12, in which a pulp fiber suspension is treated with one or more water-soluble cellulose derivatives with a degree of substitution of 0.6 to 0.95, before optional processing in a size or film press of a paper machine.

14. The process according to claim 13, in which the treatment of the pulp fiber suspension comprises one or more of the following process steps:

addition of a cellulose derivative to the pulp fiber mass in a pulper, wherein the fraction of the cellulose derivative is more than 5% by weight of the pulp fiber mass in the pulper, addition of the cellulose derivative in the head box of a paper machine, and/or application onto a still moist web of pulp suspension running in the paper machine.

15. The process according to claim 13, wherein said one or more water-soluble cellulose derivative comprises sodium-CMC.

16. The process according to claim 13, in which a pulp fiber suspension is treated with one or more water-soluble cellulose derivatives with a degree of substitution of 0.65 to 0.9 before optional processing in a size or film press of a paper machine.

* * * * *